United States Patent [19]

Geelen

[11] Patent Number: 4,683,665

[45] Date of Patent: Aug. 4, 1987

[54] DEVICE FOR COOLING A GRANULAR PRODUCT

[76] Inventor: Pierre M. L. Geelen, 't Laar 4, 6081 CW Haelen, Netherlands

[21] Appl. No.: 792,381

[22] Filed: Oct. 28, 1985

[51] Int. Cl.[4] ..... F26B 17/14

[52] U.S. Cl. ..... 34/65; 34/168; 34/185

[58] Field of Search ..... 34/62, 64, 65, 67, 165, 34/167, 168, 171, 185, 56; 222/486

[56] References Cited

U.S. PATENT DOCUMENTS

| | | | |
|---|---|---|---|
| 1,158,624 | 11/1915 | Brantingham | 34/56 |
| 1,276,044 | 8/1918 | Ellis et al. | 34/65 |
| 2,148,946 | 2/1939 | Hubmann et al. | 34/167 |
| 2,577,315 | 12/1951 | Ellerbeck | 222/486 |
| 2,861,356 | 11/1958 | Lellep | 34/185 |
| 3,241,248 | 3/1966 | Gerlach | 34/168 |
| 3,833,137 | 9/1974 | Mathews | 34/168 |
| 4,445,282 | 5/1984 | Heinemans | 34/168 |
| 4,458,428 | 7/1984 | Saeman | 34/167 |

*Primary Examiner*—Albert J. Makay
*Assistant Examiner*—David W. Westphal
*Attorney, Agent, or Firm*—Alan H. MacPherson; Richard Franklin; Michael H. La Cava

[57] ABSTRACT

Device for cooling a granular product provided with a bunker with an intake for the material to be cooled at the top side of said bunker and a grate construction located near the bottom side of said bunker, with a fixed grate and a movable grate, movable to and fro in action, whereby the movable grate has been arranged under the fixed grate, while under the movable grate a third grate has been provided, which during operation is displaceable and adjustable in several positions.

7 Claims, 3 Drawing Figures

DEVICE FOR COOLING A GRANULAR PRODUCT

The invention relates to a device for cooling a granular product provided with a bunker with an intake for the material to be cooled located at the top side of said bunker and a grate construction, located near the bottom side of said bunker with a fixed grate and a movable grate movable to and fro during operation.

A similar device is known from the U.S. Pat. No. 4,445,282. With this prior construction the movable grate is provided with plates located on two different levels, whereby the plates located on the one level have been arranged staggered relative to the plates on the other level, such that the plates on the different levels overlap each other. The fixed grate is arranged between the plates located on the different levels.

The manufacturing process of such a grate construction is complicated, and the outflow of the material can practically only be influenced by influencing the number of times that the movable grate is moved to and fro per unit time.

The purposes of the invention are to obtain a device of the aforementioned kind which has a grate construction of a relatively simple manufacturing process and which can better influence the outflow of the material.

According to the invention, this can be achieved because the movable grate has been arranged under the fixed grate, whilst under the movable grate a third grate which is displaceable and adjustable in several positions, is provided.

The manufacturing process of the grate construction according to the invention can be realized simply whilst the flow of the material through the grate construction can also be influenced by changing the position of the third grate.

Furthermore the construction can simply be made such that material is prevented from staying behind on the grates after emptying of the bunker.

The invention will be further explained hereinafter with reference to an embodiment of the construction according to the invention diagrammatically illustrated in the accompanying figures.

Figure 1:
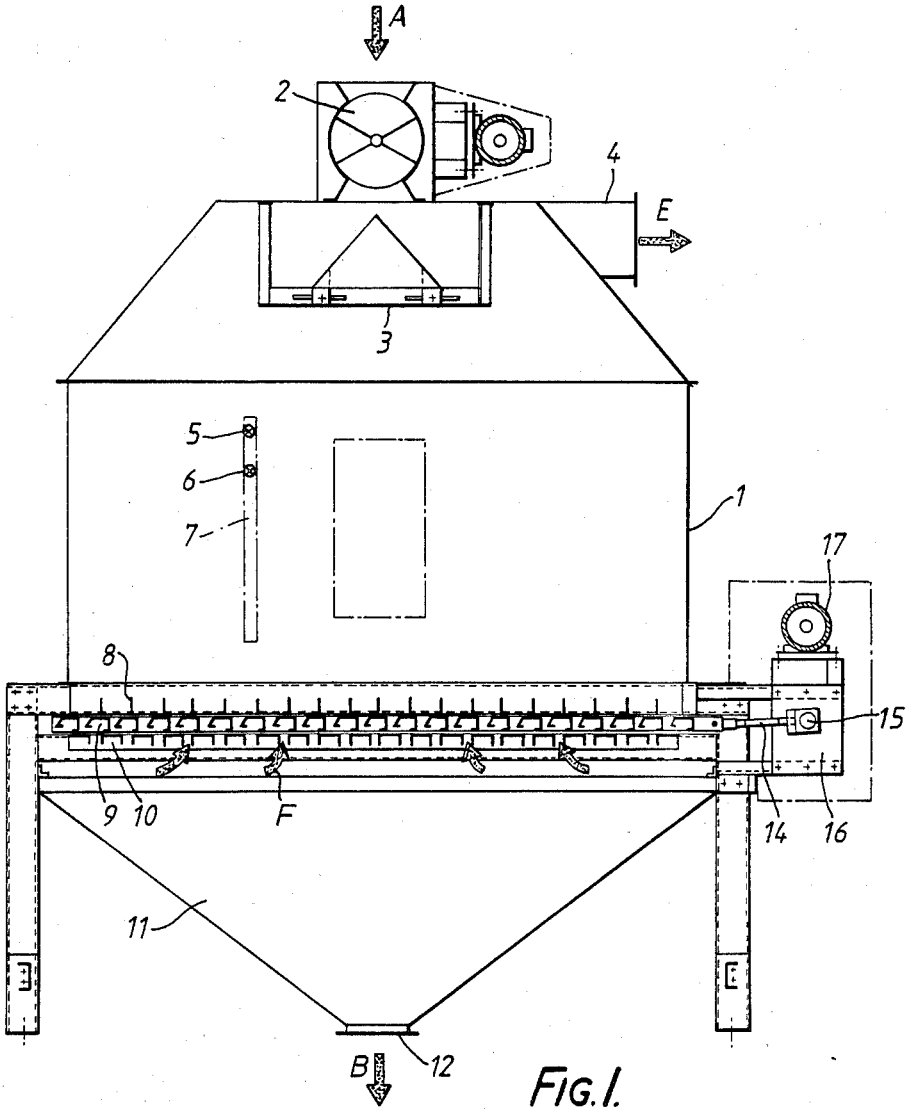
FIG. 1 is a diagrammatic sectional view of a device according to the invention.

As illustrated in FIG. 1 the device comprises a bunker 1 on the top side of which a cell-sluice 2 is provided through which granular material to be cooled can be supplied to the bunker 1, as indicated by means of the arrow A.

Under the cell-sluice a spreading device 3 is provided in the bunker through which the material streaming from the cell-sluice 2 is spread across the surface of the bunker 1. Furthermore, an outlet-branch 4 is provided on the top side of the bunker through which air is exhausted to be supplied to a cyclone, not illustrated, in which dust and air are separated from each other.

On the wall of the bunker there is further provided a pair of sensors 5 and 6, wich are adjustable from the outside of the bunker along a vertical track 7 and by means of which it is possible to observe whether or not there is material in the bunker on a level with the sensors 5 and 6.

Provided to the bottom side of the bunker is a grate construction which is built up from a fixed grate 8, a movable grate 9, movable to and fro during operation, and a grate 10, adjustable in the horizontal direction to be arranged in several positions. Under the grate construction 8–10 a tunnel 11 is arranged provided at its bottom side with an outlet 12 via which the material flows out of the cooling device as indicated by means of arrow B.

Figure 2:
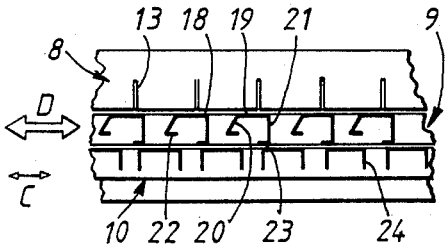
FIG. 2 illustrates on a larger scale a portion of the grate construction in a first position of the movable grate.
Figure 3:
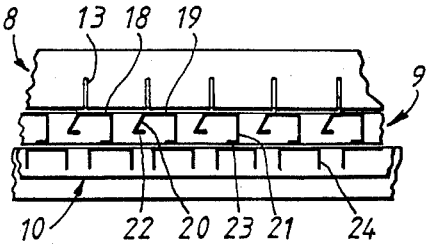
FIG. 3 illustrates on a larger scale a portion of the grate construction with the movable grate in another position.

As further illustrated in FIGS. 2 and 3, the stationary grate 8 comprises a number of strips 13, arranged regularly-spaced and parallel to each other and to a vertical plane.

The grate 9 arranged under the fixed grate is coupled, by means of a drive rod 14, with an eccentric 15, which can be driven by a motor 17 via a transmission mechanism 16.

The movable grate 9 is manufactured from a number of profile beams 18 extending parallel to each other. Every profile beam thereby comprises an upper horizontally located portion 19 to one end of which is joined a portion 20 extending downward and at an angle of 60°. A vertically extending portion 21 is joined to the longitudinal edge of the portion 19 turned away from the portion 20.

Joined to the lowermost longitudinal edge of the portion 20 is a portion 22 extending horizontally and in the direction of the portion 21. Joined to the lowermost longitudinal edge of the portion 21 is a portion 23 extending horizontally and in the direction of the portion 20. As appears from the figures, the portion 23 is thereby located on a level lower than the portion 22, whilst measured in horizontal direction there is a certain distance between the free longitudinal edges of the portions 22 and 23.

The lowermost grate 10 is constructed from a number of beams 24 with a U-shaped section, extending parallel to each other, whose legs, extending parallel to each other, are directed downwards.

Joined to the grate 10 manufactured from the beams 24 are adjusting cylinders, not further illustrated, by means of which said bottom grate 10, as indicated by the double arrow C, can be displaced to and fro along a certain distance and be put in any staionary position desired.

While in action the material to be cooled will be supplied to the inside of the bunker 1 via the cell-sluice 2. The outflow of the material is effected by making the grate 9 move to and fro as indicated by the double arrow D in FIG. 2.

The operation of the cell-sluice 2 and the shaking grate 9 is checked by the sensor 6 such that the level on which the grain-shaped material to be cooled fills the bunker 1 stays within certain limits, depending on the adjustment of the sensor 6.

Sensor 5 is a safety device preventing too much material from being supplied into the bunker.

While in action, hot air is furthermore exhausted from the bunker 1 via the outlet branch 4, as indicated by means of the arrow E, whereby cold air will flow into the bottom of the bunker via the grate construction, as indicated by means of the arrows F in FIG. 1.

When the movable grate 9 takes its utmost left-hand position, as illustrated in FIG. 2, the arrangement of said movable grate relative to the bottom grate 10 taking its utmost right-hand position is such that while stopped no material will flow out of the bunker, as the base of the triangle formed by the natural slope of the material lying on the beams 24 of bottom grate 10 will be smaller than the width of said beams 24.

On moving movable grate 9 to its utmost right-hand position as illustrated in FIG. 3, however, it will be possible for material to flow downward through the grate construction, which flow is stopped again on the return movement of the movable grate to its left-hand position.

The quantity of material which flows through the grate construction with a to and fro movement of the grate 9 can now be influenced even further by adjusting the bottom grate 10. Said grate 10 can be displaced to the left from its utmost right-hand position illustrated in FIGS. 2 and 3 along a certain distance, as seen in the figures, and be secured in a desired position. From FIG. 3, in particular, it will be apparent that the further the bottom grate 10 is displaced to the left from the position illustrated in FIG. 3, the larger the passage for the material flowing out of the bunker becomes, so that more material will flow out of the bunker per to and fro movement of the grate proportional to the adjustment of the bottom grate 10 to the left.

This adjusting possibility of the grate 10 also makes it possible if desired, to empty the bunker completely and quickly, by adjusting the two grates 9 and 10, relative to each other such that a free passage for the material from the bunker is formed.

As will further appear from FIGS. 2 and 3, the portions 19 of the profile beams 18 will move, with a to and fro movement of the grate 9, across their entire width under the strips 13, so that material is prevented from sticking to said portions 19 and also all material can be struck from the beams 18 on emptying the bunker.

After emptying the bunker as stated above, grid 10 can be displaced with respect to grid 9 so that material lying on the beams 24 will be shifted from said beams by the portions 23 of the beams 18 of the grate 9 moving along them.

What is claimed is:

1. Device for cooling a granular product provided with a bunker with an intake for the material to be cooled at the top side of said bunker and a grate construction located near the bottom side of said bunker comprising a fixed grate and a movable grate movable to and fro in action, over a length of travel, and a third grate characterised in that the movable grate has been arranged under the fixed grate, whilst under the movable grate said third grate has been provided, which during operation is displaceable laterally and adjustable in several positions.

2. Device as claimed in claim 1, characterised in that the fixed grate is formed by strips standing vertically and extending parallel to each other.

3. Device as claimed in claim 1 or 2, characterised in that the movable grate has a number of profile beams extending parallel to each other, having a horizontally extending upper portion and, on a longitudinal edge of said upper portion, a portion sloping downwards.

4. Device as claimed in claim 3, characterised in that the width of the horizontally extending upper portion of said movable grate is equal to or smaller than the travel of the movable grate and the strips of the upper grate are arranged such that the horizontally extending portions move under the strips across the entire width of said horizontally extending portions.

5. Device as claimed in claim 3, characterized in that the movable grate is movable relative to the bottom grate between a position in which the passage between two profiles of the movable grate is closed in a vertical direction by a profile of the bottom grate located thereunder and a position in which the passage between two profiles of the movable grate at least partially aligns in a vertical direction with the passage between two profiles of the bottom grate.

6. Device as claimed in claim 5, characterised in that the movable grate and the bottom grate are adjustable relative to each other such that the passages in said grates can overlap each other completely.

7. Device as in claim 5, characterised in that the bottom grate comprises profile beams with upper horizontal portions which, at least in one position of the movable grate, can be moved across the entire width of said upper horizontal portions of said profile beams with respect to portions of the movable grate.

* * * * *